US008668289B2

(12) United States Patent
Lee et al.

(10) Patent No.: US 8,668,289 B2
(45) Date of Patent: Mar. 11, 2014

(54) AUTOMATIC DOOR OPENING/CLOSING APPARATUS AND REFRIGERATOR HAVING THE SAME

(75) Inventors: Jong Dal Lee, Gwangju (KR); Jae Hoon Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 338 days.

(21) Appl. No.: 12/875,454

(22) Filed: Sep. 3, 2010

(65) Prior Publication Data

US 2011/0050065 A1 Mar. 3, 2011

(30) Foreign Application Priority Data

Sep. 3, 2009 (KR) ..... 10-2009-0083056

(51) Int. Cl.
*A47B 96/04* (2006.01)

(52) U.S. Cl.
USPC ..... 312/402; 312/405

(58) Field of Classification Search
USPC ..... 312/405, 333, 330.1, 319.1, 319.5, 312/319.7, 319, 8, 331, 402, 405.1
See application file for complete search history.

(56) References Cited

U.S. PATENT DOCUMENTS

| | | | | |
|---|---|---|---|---|
| 4,828,344 | A * | 5/1989 | Omata | 312/319.1 |
| 5,915,805 | A * | 6/1999 | Lee | 312/405 |
| 6,125,028 | A * | 9/2000 | Matsumoto | 361/679.22 |
| 6,533,375 | B2 * | 3/2003 | Fulterer et al. | 312/319.8 |
| 6,655,765 | B2 * | 12/2003 | Kawamura et al. | 312/405 |
| 7,159,957 | B2 * | 1/2007 | Huber et al. | 312/331 |
| 2003/0076235 | A1 * | 4/2003 | Tsui | 340/686.1 |
| 2003/0122519 | A1 * | 7/2003 | Huber et al. | 318/646 |
| 2005/0160854 | A1 * | 7/2005 | Rotter | 74/422 |
| 2006/0049729 | A1 * | 3/2006 | Mussche | 312/319.6 |
| 2007/0267401 | A1 * | 11/2007 | Collene et al. | 219/391 |
| 2008/0315739 | A1 * | 12/2008 | Hirano | 312/330.1 |
| 2009/0160297 | A1 * | 6/2009 | Anikhindi et al. | 312/319.7 |
| 2010/0168920 | A1 * | 7/2010 | Hooker et al. | 700/275 |

FOREIGN PATENT DOCUMENTS

| | | |
|---|---|---|
| JP | 2-106686 | 4/1990 |
| JP | 2000-220957 | 8/2000 |

* cited by examiner

*Primary Examiner* — Matthew Ing
(74) *Attorney, Agent, or Firm* — Staas & Halsey LLP

(57) ABSTRACT

An automatic door opening/closing apparatus automatically opening and closing a door without applying any manual force to the door, and a refrigerator having the automatic door opening/closing apparatus. The automatic door opening/closing apparatus devised to automatically open or close a sliding door that is mounted, in a drawer manner, to a refrigerator body, includes a drive device coupled to the sliding door to automatically open or close the sliding door with respect to the refrigerator body, an input part to receive an user input and to operate the drive device based on the user input, a sensing part to sense an open or closed state of the sliding door, and a controller to operate the drive device based on signals from the input part and signals from the sensing part.

16 Claims, 13 Drawing Sheets

AUTOMATIC DOOR OPENING/CLOSING APPARATUS AND REFRIGERATOR HAVING THE SAME

CROSS-REFERENCE TO RELATED APPLICATION

This application claims the benefit of Korean Patent Application No. 2009-0083056, filed on Sep. 3, 2009 in the Korean Intellectual Property Office, the disclosure of which is incorporated herein by reference.

BACKGROUND

1. Field

Embodiments of the present invention relate to an automatic door opening/closing apparatus to automatically open or close a drawer type door, and a refrigerator having the same.

2. Description of the Related Art

Generally, home electronics, such as, e.g., refrigerators, have doors to open or close the interior of a body.

The doors are classified into rotary type doors and drawer type doors. Especially, a drawer type door is integrally provided with a storage basket, so that the storage basket moves forward out of a body as the door is opened, allowing a user to easily remove items received in the storage basket.

If the above-described drawer type door and storage basket have a large size, the user may need to exert considerable force to open or close the door.

In particular, if a handle of the drawer type door is located higher or lower than the user's shoulder, the user may have difficulty opening or closing the drawer type door.

For this reason, various door opening apparatuses have been proposed, which achieve a balance between the exterior pressure and the interior pressure of a body upon initial opening of the drawer type door, thereby assisting smooth opening of the door.

However, the above-described door opening apparatuses merely function to alleviate an initial opening force. If heavy items are placed in the storage basket, it may take considerable force to open the door with the storage basket despite the use of the door opening apparatus.

SUMMARY

Therefore, it is an aspect of an embodiment of the present invention to provide an automatic door opening/closing apparatus to automatically open or close a door without applying any manual force to the door, and a refrigerator having the same.

It is another aspect of an embodiment of the present invention to provide an automatic door opening/closing apparatus designed to be operated based on detection of whether a door is in an open state or closed state, and a refrigerator having the same.

It is a further aspect of an embodiment of the present invention to provide an automatic door opening/closing apparatus to substantially eliminate unbalanced opening/closing operation of a door, and a refrigerator having the same.

Additional aspects of an embodiment of the invention will be set forth in part in the description which follows and, in part, will be obvious from the description, or may be learned by practice of the invention.

In accordance with one aspect of an embodiment of the present invention, an automatic door opening/closing apparatus to automatically open or close a sliding door that is mounted in a drawer manner to a refrigerator body includes a drive device coupled to the sliding door to automatically open or close the sliding door with respect to the refrigerator body, an input part to receive an user input and to operate the drive device based on the user input, a sensing part to sense an open or closed state of the sliding door, and a controller to operate the drive device based on signals from the input part and signals from the sensing part.

The sliding door may include a rack gear corresponding to the gear unit, so as to be moved forward or rearward by rotation of the gear unit.

The sliding door may include a connecting rod unit to connect a pair of sliding devices provided at the sliding door, to prevent unbalanced opening/closing operation of the sliding door The connecting rod unit may include a pair of pinions and a rod member to connect the pair of pinions to each other, and the refrigerator body may include a pair of rack gears corresponding to the pair of pinions.

The drive device may be mounted to the sliding door, and the gear unit may be connected to the rod member to transmit rotating power of the drive motor to the connecting rod unit.

The automatic door opening/closing apparatus may further include a power cable to supply power to the drive device and a cable guide unit to prevent breakage of the power cable during opening/closing operation of the sliding door.

The input part may include an open key to open the sliding door and a close key to close the sliding door, the open key and close key being provided at one of refrigerator doors.

The drive device may be operated in correspondence to an operating time of the open key.

The input part may include a voice recognizer that transmits door opening/closing signals to the controller based on recognition of a user's voice.

The sliding door may include a door handle, and the input part may comprise a switch provided at the door handle.

The sensing part may include a sensor provided on at least any one of the body and sliding door and a sensor operator provided on the other one of the body and sliding door to apply a pressure force to the sensor.

The controller may operate the drive device if an input signal is applied from the input part, and may terminate operation of the drive device if a signal informing of the open or closed state of the sliding door is applied from the sensing part.

The sliding door may be provided with a storage basket, which can be pulled out of and pushed in a storage compartment of the refrigerator body as the sliding door is moved between the open state and the closed state in a sliding manner, the drive device comprises a drive motor mounted within an interior of the storage compartment of the refrigerator body, and the storage basket includes an indented portion shaped to avoid contact with the drive motor mounted within the interior of the storage compartment as the sliding door is moved between the open state to the closed state.

the sliding door may include a gasket attached to a rim of a rear surface thereof, the sensing part is configured such that the closed state of the sliding door is sensed after the gasket of the sliding door initially establishes contact with the refrigerator body.

In accordance with another aspect of an embodiment of the present invention, a refrigerator includes a refrigerator body having storage compartment, a sliding door to open or close the storage compartment, a pair of sliding devices provided at the sliding door, a pair of first rack gears provided at opposite inner side surfaces of the storage compartment, a connecting rod unit to connect the pair of sliding devices to each other, the connecting rod unit including a pair of pinions corresponding to the first rack gears and a rod member to connect the pair of pinions to each other, and an automatic door opening/closing apparatus to automatically open or close the sliding door, and the automatic door opening/closing apparatus includes a drive device, an input part to operate the drive device, and a sensing part to sense an open or closed state of the door.

The drive device may include a drive motor mounted to the sliding door configured to transmit rotating power of the drive motor to the connecting rod unit.

the drive device may include a reduction gear directly connected to the rod member, serving to transmit rotating power of the drive motor to the connecting rod unit.

The sliding door may include a rack gear, and the drive device may include a drive motor mounted to the storage compartment, and a gear unit connected to the drive motor, the gear unit being engaged with the rack gear of the sliding door.

the sliding door may be provided with a storage basket which moves into and out of the storage compartment as the sliding door is moved between a open state and a close state, wherein the storage basket includes an indented portion shaped to avoid contact with the drive motor mounted within an interior of the storage compartment as the sliding door is moved between the open state to the closed state.

the sliding door may include a gasket attached to a rim of a rear surface thereof, the sensing part is configured such that the closed state of the sliding door is sensed after the gasket of the sliding door initially establishes contact with the refrigerator body.

In accordance with another aspect of an embodiment of the present invention, a refrigerator includes a refrigerator body, a refrigerating compartment and a freezing compartment vertically divided in the refrigerator body, a drawer type door to open or close the freezing compartment, a pair of sliding devices provided at the drawer type door, a connecting rod unit to connect the pair of sliding devices to each other, to prevent unbalanced opening/closing operation of the door, pinions provided respectively at both ends of the connecting rod unit, a pair of rack gears provided at side surfaces of the freezing compartment to correspond to the pinions, a drive motor mounted to the drawer type door, and a gear to directly transmit drive power of the drive motor to the connecting rod unit.

In accordance with a further aspect of an embodiment of the present invention, a refrigerator includes a refrigerator body, a refrigerating compartment and a freezing compartment vertically divided in the refrigerator body, a drawer type door to open or close the freezing compartment, a pair of sliding devices provided at the drawer type door, a connecting rod unit to connect the pair of sliding devices to each other, to prevent unbalanced opening/closing operation of the door, pinions provided respectively at both ends of the connecting rod unit, a pair of first rack gears provided at side surfaces of the freezing compartment to correspond to the pinions, a drive motor mounted to the freezing compartment, a gear unit connected to the drive motor, and a second rack gear provided at the drawer type door and serving to convert rotation of the gear unit into linear movement so as to move the drawer type door forward or rearward.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
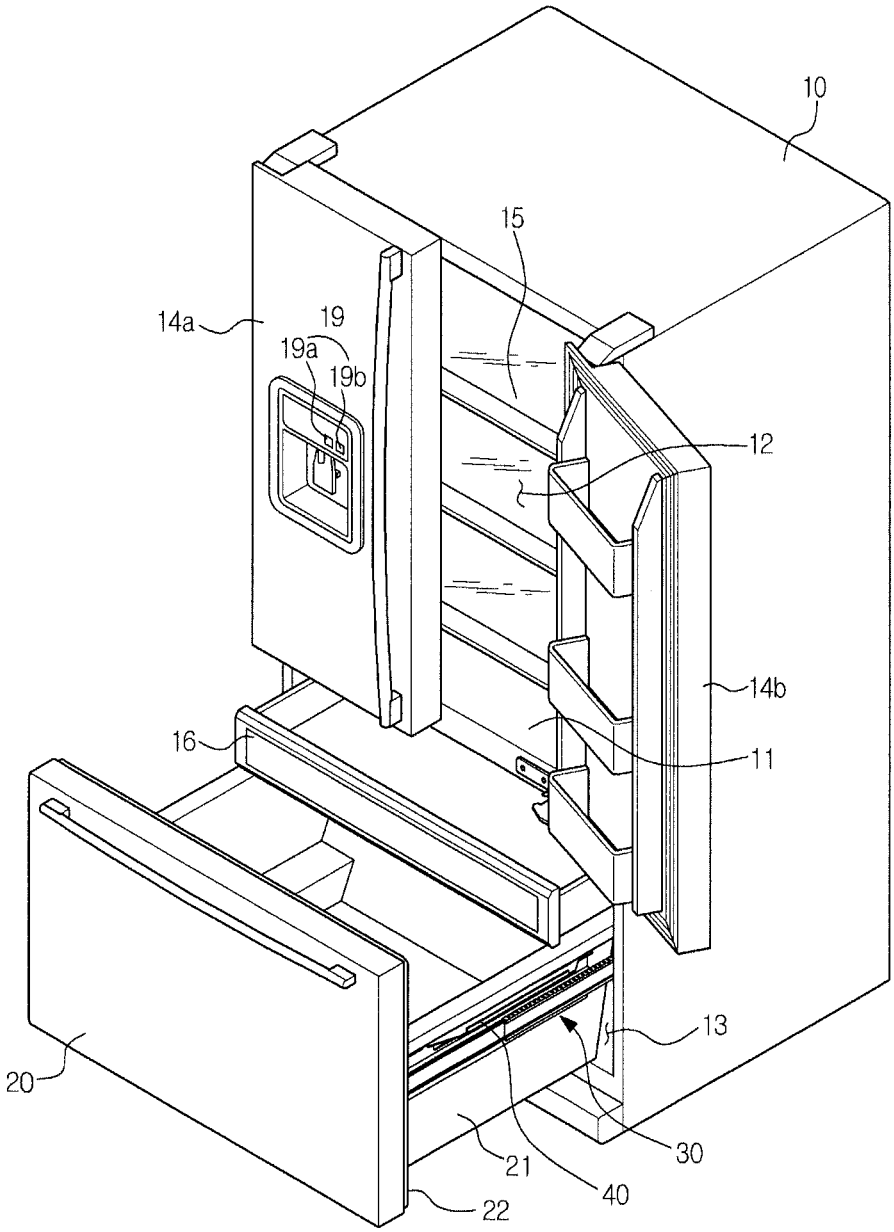
FIG. 1 is a perspective view illustrating an external appearance of a refrigerator according to one exemplary embodiment.

Reference will now be made in detail to the embodiments of the present invention, examples of which are illustrated in the accompanying drawings, wherein like reference numerals refer to like elements throughout.

First, a refrigerator according to one exemplary embodiment of the present invention will be described with reference to the accompanying drawings.

Figure 2:
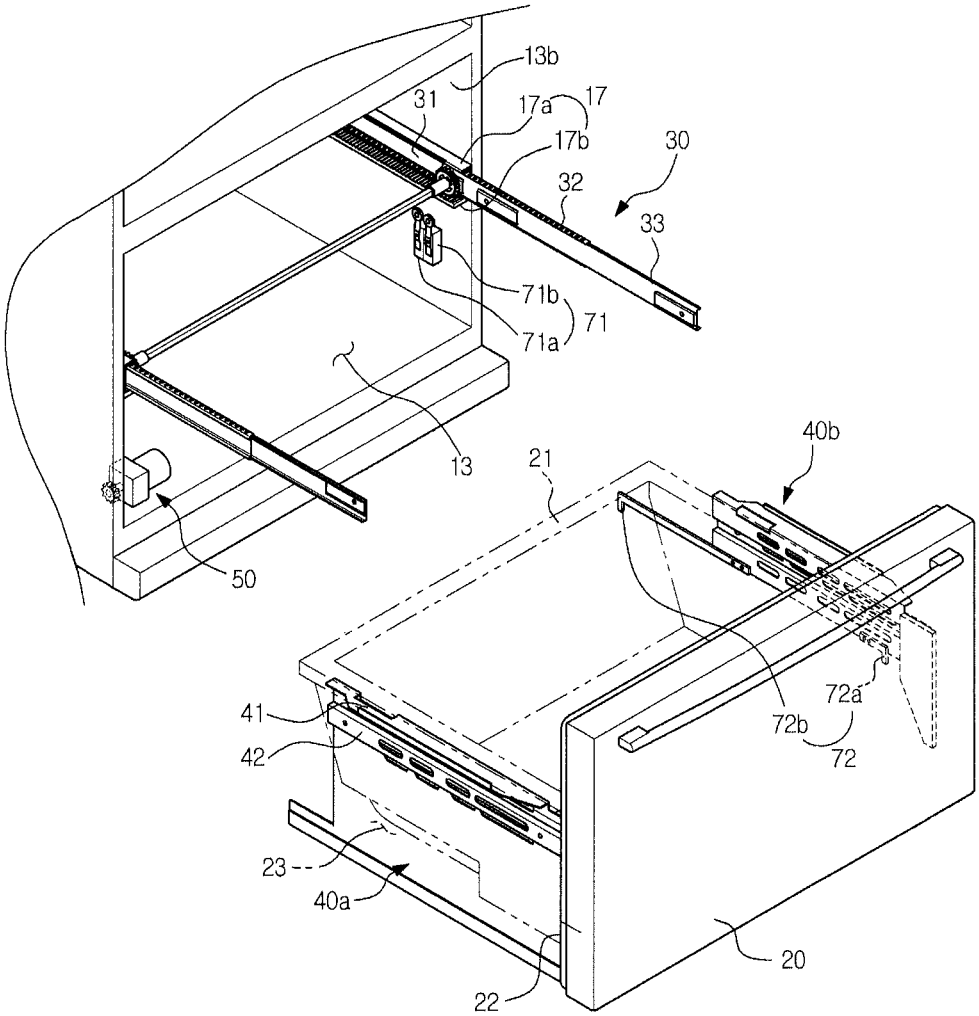
FIG. 2 is an exploded perspective view illustrating a storage compartment of the refrigerator shown in FIG. 1.
Figure 3:
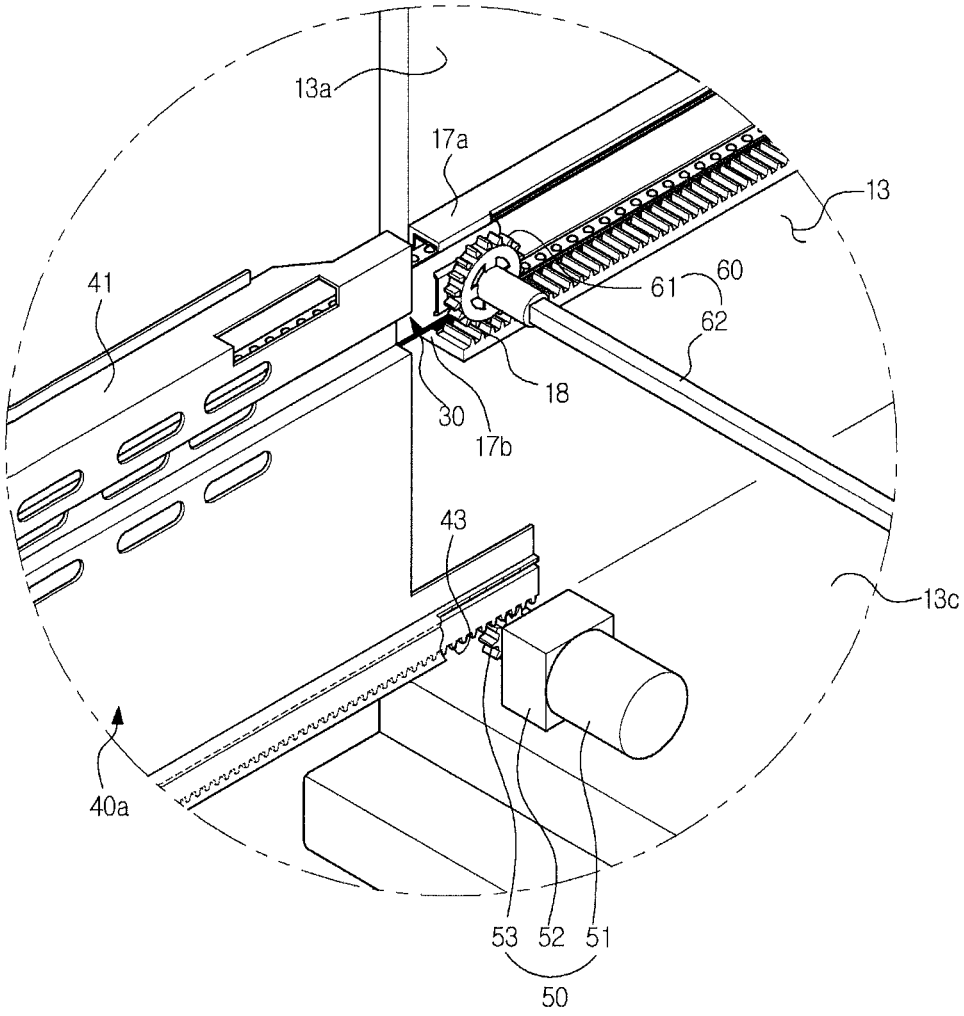
FIG. 3 is an enlarged perspective view illustrating important parts of the refrigerator shown in FIG. 1.

FIG. 1 is a perspective view illustrating an external appearance of a refrigerator according to one exemplary embodiment of the present invention. FIG. 2 is an exploded perspective view illustrating a storage compartment (i.e. a second storage compartment as will be described hereinafter) of the refrigerator shown in FIG. 1, and FIG. 3 is an enlarged perspective view illustrating important parts of the refrigerator shown in FIG. 1.

Figure 4:
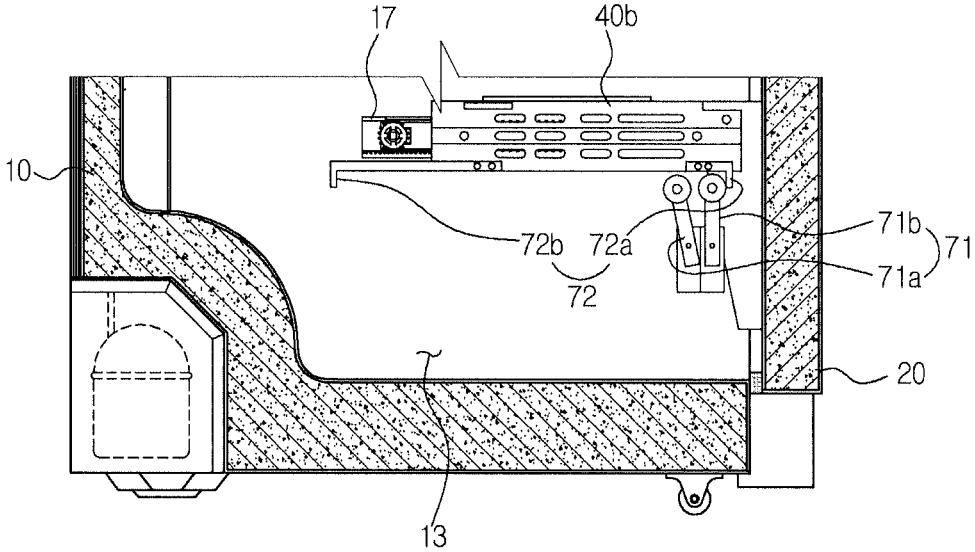
FIG. 4 is a view illustrating a closed state of the storage compartment of the refrigerator shown in FIG. 1.
Figure 5:
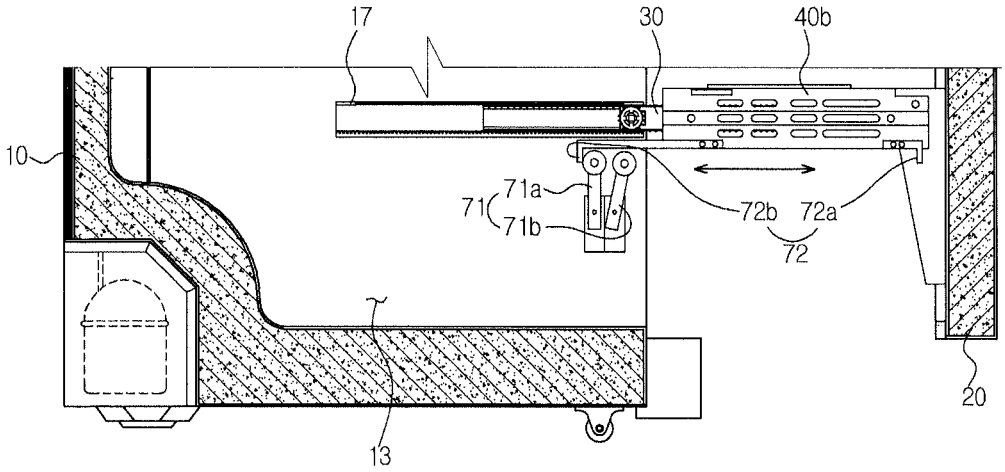
FIG. 5 is a view illustrating an open state of the storage compartment of the refrigerator shown in FIG. 1.

In addition, FIG. 4 is a view illustrating a closed state of the storage compartment of the refrigerator shown in FIG. 1, and FIG. 5 is a view illustrating an open state of the storage compartment of the refrigerator shown in FIG. 1.

The refrigerator according to the embodiment, as shown in FIG. 1, includes a body 10 having first and second storage compartments 12 and 13 vertically divided by an insulating partition 11, first storage compartment doors 14; 14*a* and 14*b* provided at a front side of the first storage compartment 12 and used to open or close the first storage compartment 12, a second storage compartment door 20 provided at a front side of the second storage compartment 13 and used to open or close the second storage compartment 13, and an automatic door opening/closing apparatus to automatically open or close the second storage compartment door 20.

It is naturally understood that the refrigerator according to the embodiment, similar to general refrigerators, includes elements required to constitute a refrigeration cycle, such as, e.g., a compressor (not shown), condenser (not shown), expander (not shown), and evaporator (not shown).

Here, the first storage compartment 12 may be set to a refrigerating compartment, and the second storage compartment 13 may be set to a freezing compartment. Of course, each storage compartment may be converted to a refrigerating compartment or a freezing compartment when in use.

The refrigerator according to the embodiment, for example, is a so-called French type refrigerator as a kind of Bottom Mounted Freezer (BMF) refrigerators, in which the second storage compartment 13 is set to a freezing compartment and the first storage compartment 12 is set to a refrigerating compartment. In this kind of refrigerator, the respective storage compartments have a lager width than Side By Side (SBS) refrigerators, Top Mounted Freezer (TMF) refrigerators, and other general BMF refrigerators, in order to receive a relatively wide item, such as, e.g., a pizza.

Shelves 15 to receive, e.g., food for refrigeration storage, are installed, at predetermined intervals, in the first storage compartment 12. Also, a receiving basket 16 to receive, e.g., food for freezing storage, is slidably installed in an upper region of the second storage compartment 13.

Since the first storage compartment 12 has large vertical and horizontal widths, providing a single door designed to be pivotally rotated leftward or rightward may cause leakage of a great amount of cold air from the first storage compartment 12 when the door is opened. Moreover, the door inevitably has a large size and therefore, the user may need to exert considerable force to open or close the door.

For this reason, a pair of the first storage compartment doors 14 is provided at the first storage compartment 12, which are pivotally rotatable leftward or rightward.

The second storage compartment door 20, used to open or close the second storage compartment 13, takes the form of a drawer type door to be opened or closed in a sliding manner. A storage box 21 is integrally or detachably mounted to the second storage compartment door 20. As the storage box 21 is pulled out forward upon opening of the second storage compartment door 20, the user may easily put, e.g. food, into the storage box 21, or remove the food from the storage box 21.

The second storage compartment door 20, as shown in FIGS. 1 and 2, includes a gasket 22 attached to the rim of a rear surface thereof, a pair of sliding devices 30 to enable sliding opening/closing operation of the second storage compartment door 20, and a pair of supporting members 40; 40*a* and 40*b* coupled to the rear surface of the second storage compartment door 20, the supporting members serving to assist stable seating of the storage box 21.

Each of the pair of sliding devices 30 may take the form of a triple rail, which consists of first to third rails 31, 32 and 33. The first rail 31 is fixed to either side surface of the second storage compartment 13. The second rail 32 has a width suitable to be received in the first rail 31 so as to be movably fitted into the first rail 31. The third rail 33 is fixed to an outer surface of the corresponding supporting member 40 and has a width suitable to be received in the second rail 32 so as to be movably fitted into the second rail 32.

The triple rail type sliding device 30 is devised to increase the maximum opening distance of the second storage compartment door 20 and, of course, a general double rail type sliding device may also be employed in the embodiment.

Bearings (not shown) are provided in a rolling manner between the respective rails 31, 32 and 33 of the sliding device 30, assuring easy entrance/exit of the drawer type second storage compartment door 20.

The first rail 31, as shown in FIGS. 2 and 3, is fixed to the corresponding side surface 13*a* or 13*b* of the second storage compartment 13. Each side surface 13*a* or 13*b* of the second storage compartment 13 is provided with a rail housing 17 to fix the first rail 31.

The rail housing 17 internally defines a predetermined space to receive the first rail 31. The rail housing 17 consists of an upper housing 17*a* to keep the top of the first rail 31 fixed and a lower housing 17*b* to keep the bottom of the first rail 31 fixed.

Accordingly, the rail housing 17 is shaped to surround an outer surface of the first rail 31, serving to firmly keep the first rail 31 fixed.

Each of the pair of supporting members 40; 40*a* and 40*b* protrudes perpendicular to the rear surface of the second storage compartment door 20. Each supporting member 40 may be integrally formed with the rear surface of the second storage compartment door 20, or may be fastened to the rear surface of the second storage compartment door 20 by screws.

The supporting member 40 has a supporting surface 41 at an upper end thereof, to support the second storage box 21. A rail mount 42, to which the third rail 33 of the sliding device 30 is mounted, is provided at an outer surface of the supporting member 40.

Accordingly, upon opening of the second storage compartment door 20, the second storage compartment door 20 slidably moves forward by operation of the sliding device 30. Similarly, upon closing of the second storage compartment door 20, the second storage compartment door 20 slidably moves rearward by operation of the sliding device 30.

Since the second storage compartment 13 has the single second storage compartment door 20, opening the door 20 of the second storage compartment 13 may need a greater force than opening the doors 14 of the first storage compartment 12, due to the magnetic force of the gasket 22 on the rim of the door rear surface, the weight of the second storage compartment door 20 and storage box 21, the weight of items stored in the storage box 21, the pressure difference between the outside and inside of the second storage compartment 13, and the like. Moreover, to open the second storage compartment door 20 of the second storage compartment 13, the user may stoop to pull out the second storage compartment door 20 forward. This inconvenient posture consequently may make very difficult for the user to open or close the second storage compartment door 20.

To eliminate opening inconvenience of the user related to the second storage compartment door 20, the embodiment provides the automatic door opening/closing apparatus to automatically open or close the second storage compartment door 20 without applying any manual force to the second storage compartment door 20.

The automatic door opening/closing apparatus, as shown in FIGS. 1 to 5 and FIG. 10, may include a drive device 50, input part 19, sensing part 70, and controller 80.

The drive device 50, as shown in FIGS. 2 and 3, may include a drive motor 51 fixed on an inner shell bottom surface 13*c* of the second storage compartment 13, and a gear unit to transmit rotating power of the drive motor 51 to the second storage compartment door 20.

By positioning the drive motor 51 on the inner shell bottom surface 13*c* at a position close to an inner shell side surface, it may be possible to secure an installation position of the drive motor 51 while minimizing reduction in the capacity of the storage box 21 coupled to the supporting members 40. Alternatively, of course, the drive motor 51 may be fixed to the inner shell side surface, i.e. the side surface 13*a* of the second storage compartment 13, to minimize reduction in the capacity of the storage box 21.

The gear unit includes a reduction gear 52 connected to the drive motor 51, and a first pinion 53 engaged with the reduction gear 52.

Although the embodiment employs a rack-and-pinion mechanism to move the second storage compartment door 20 forward and rearward by converting rotation of the drive motor 51 into linear movement, of course, various other mechanical configurations to convert rotation of the drive motor 51 into linear movement may be employed.

Since the drive device 50 is fixed on the inner shell bottom surface 13*a*, the storage box 21 may come into contact with the drive device 50 as the second storage compartment door 20 is moved between the open state and the closed state. In the present embodiment, to prevent the storage box 21 from coming into contact with the drive device 50 upon forward or rearward movement thereof, the storage box 21 may be provided at a position corresponding to the drive device 50 with an indented portion 23 to receive the drive device 50.

Any one supporting member 40*a* of the pair of supporting members 40 of the second storage compartment door 20 is provided with a first rack gear 43, the first rack gear 43 being engaged with the first pinion 53. The first rack gear 43 may longitudinally extend lengthwise at a lower end of the supporting member 40*a*, serving to move the second storage compartment door 20 forward and rearward according to rotation of the first pinion 53 during operation of the drive motor 51.

Due to the fact that the drive device 50 for automatic opening/closing operation of the second storage compartment door 20 is engaged with the first rack gear 43 provided at any one supporting member 40*a* of the pair of supporting members 40, when the second storage compartment door 20 is opened or closed by operation of the drive device 50, it may be difficult to balance opening/closing operation of left and right sides of the second storage compartment door 20. To prevent the resulting horizontal unbalance from making opening/closing operation of the second storage compartment door 20 unstable, the second storage compartment door 20 is provided with a connecting rod unit 60.

The connecting rod unit 60 serves to prevent unbalanced opening/closing operation of left and right sides of the second storage compartment door 20. The connecting rod unit 60 includes a pair of second pinions 61 rotatably fitted to the first rail 31, and a rod member 62 to connect the pair of second pinions 61 to each other.

The rail housings 17 provided at the second storage compartment 13, i.e. the lower housings 17*b* are provided with second rack gears 18, the second rack gears 18 being engaged with the respective second pinions 61. Upon opening or closing of the second storage compartment door 20, the second pinions 61 of the connecting rod unit 60 are engaged with the second rack gears 18, so as to enable balanced movement of the second storage compartment door 20.

That is, as a result of the second pinions 61 of the connecting rod unit 60 being engaged and rotated along the second rack gears 18, it may be possible to prevent unbalanced opening/closing operation of the second storage compartment door 20 during forward or rearward movement of the second storage compartment 20 and consequently, to assure smooth opening/closing operation of the second storage compartment door 20.

The input part 19, as shown in FIG. 1, includes an open key 19*a* and a close key 19*b* provided at the first storage compartment door 14, the open key 19*a* serving to apply an opening signal to the second storage compartment door 20, and the close key 19*b* serving to apply a closing signal to the second storage compartment door 20.

The drive motor 51 is operated in correspondence to a pushed time of the open key 19*a* and close key 19*b*, allowing the user to adjust the opening/closing rate of the second storage compartment door 20.

Alternatively, a single key may be provided instead of separately providing the open key 19*a* and close key 19*b*. For example, the second storage compartment door 20 may be moved in an opening direction when the key is pushed in a closed state of the door, and may be moved in a closing direction when the key is pushed in an open state of the door.

Figure 11:
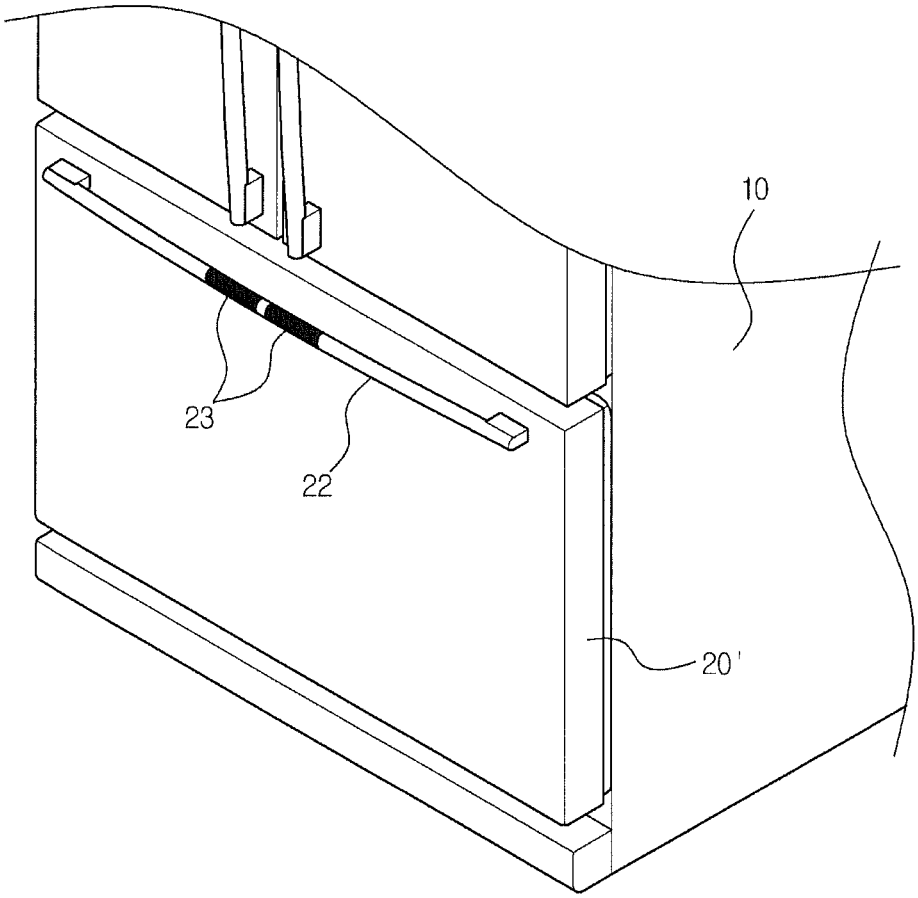
FIG. 11 is a perspective view illustrating a storage compartment door of a refrigerator according to an alteration of the embodiments.

Although the input part 19 may be provided at the first storage compartment door 14, alternatively, an input part 23 may be provided at a handle 22 of a second storage compartment door 20' as shown in FIG. 11.

In this case, by manipulating the input part 23 provided at the handle 22 of the second storage compartment door 20' to operate the drive device 50, the user may open or close the second storage compartment door 20' without applying any force to the second storage compartment door 20.

Both the input parts 19 and 23 may include a push switch or touch switch, a voice recognizer to apply an opening or closing signal based on recognition of a user's voice, and various other elements to apply an opening or closing signal based on user manipulation.

The sensing part 70; 71 and 72 serves to sense the open or closed state of the second storage compartment door 20. The sensing part 70 may include a sensor 71 attached to the side surface 13*b* of the second storage compartment 13, and a sensor operator 72 formed at the second supporting member 40 of the second storage compartment door 20, the sensor operator 72 serving to apply a signal to the sensor 71.

The sensor 71 functions to generate a signal when being pressed by an external force. The sensor 71 may include a first sensor 71*a* to sense a closed state of the second storage compartment door 20, and a second sensor 71*b* to sense the maximally open state of the second storage compartment door 20. Although the first sensor 71*a* and second sensor 71*b* may be separately provided, it is naturally understood that integrally forming the first and second sensors 71*a* and 71*b* with each other may be possible.

The sensor operator 72 serves to press the sensor 71. The sensor operator 72 includes a first sensor operator 72*a* having a tip end protruding downward from the second supporting member 40 at a position adjacent to the rear surface of the second storage compartment door 20, and a second sensor operator 72*b* extending from the second supporting member 40 inward of the second storage compartment 13 and having a downwardly protruding tip end.

The first sensor operator 72*a*, as shown in FIG. 4, presses the first sensor 71*a* when the second storage compartment door 20 is closed, allowing the first sensor 71*a* to sense that the second storage compartment door 20 is completely closed. The second sensor operator 72*b*, as shown in FIG. 5, presses the second sensor 71*b* when the second storage compartment door 20 is opened, allowing the second sensor 71*b* to sense that the second storage compartment door 20 is opened to the maximum extent.

With appropriate arrangement of the first sensor operator 72*a* and the first sensor 71*a*, the closed state of the second storage compartment door 20 may be sensed if the gasket 22 provided at the rear surface of the second storage compartment door 20 comes into contact with the refrigerator body 10.

The controller 80 is provided to control operation of the drive device 50 based on signals of the input part 19 and sensing part 70.

The controller 80 rotates the drive motor 51 in a given direction to open the second storage compartment door 20 when the input part 19 generates an opening signal.

For example, assuming that the input part 19 includes the open key 19*a* and close key 19*b* to operate the drive motor 51 in correspondence to a pushed time thereof, the controller 80 applies a signal to the drive motor 51 when the user pushes the open key 19*a*, thereby operating the drive motor 51 for a time corresponding to the operating time of the open key 19*a*.

Accordingly, the user may achieve a required opening rate of the second storage compartment door 20 via manipulation of the open key 19*a*.

Once the open key 19*a* is operated for an extended time and thus, the second storage compartment door 20 reaches the maximally open state thereof as shown in FIG. 5, the sensing part 70 senses the maximally open state even if the open key 19*a* is continuously operated and thus, applies a signal to the controller 80 so as to allow the controller 80 to terminate operation of the drive motor 51. This may prevent overload of the drive motor 51 caused when the drive motor 51 is continuously operated in the maximally open state of the door.

Similarly, the required opening rate may be accomplished via manipulation of the close key 19*b*.

Specifically, if the close key 19*b* is manipulated in the open state of the door, the controller 80 applies a signal to the drive motor 51 so as to rotate the drive motor 51 in a second direction, causing the second storage compartment door 20 to be moved in a closing direction thereof.

Once the second storage compartment door 20 is completely closed as shown in FIG. 4, the sensing part 70 senses the closed state and thus, applies a signal to the controller 80 so as to allow the controller 80 to terminate operation of the drive motor 51. This may prevent overload of the drive motor 51 caused when the drive motor 51 is continuously operated even in the closed state of the door.

The above-described embodiment may employ the single input part 19. In this case, if the input part 19 applies a signal in the closed state of the door, the controller 80 operates the drive motor 51 to open the second storage compartment door 20 to the maximum extent. Then, if the sensing part 70 senses the maximally open state of the door and applies a signal to the controller 80, the controller 80 terminates operation of the drive motor 51, completing opening operation of the second storage compartment door 20. In addition, if the input part 19 applies a signal in the open state of the door, the controller 80 operates the drive motor 51 to close the second storage compartment door 20. Then, if the sensing part 70 senses the closed state of the door and applies a signal to the controller 80, the controller 80 terminates operation of the drive motor 51, completing closing operation of the second storage compartment door 20.

Of course, the above-described operation may be identically applied to the case where the input part 19 is a voice recognizer that transmits door opening/closing signals to open or close a door in response to a user's voice.

Next, a refrigerator according to another embodiment of the present invention will be described.

Figure 6:
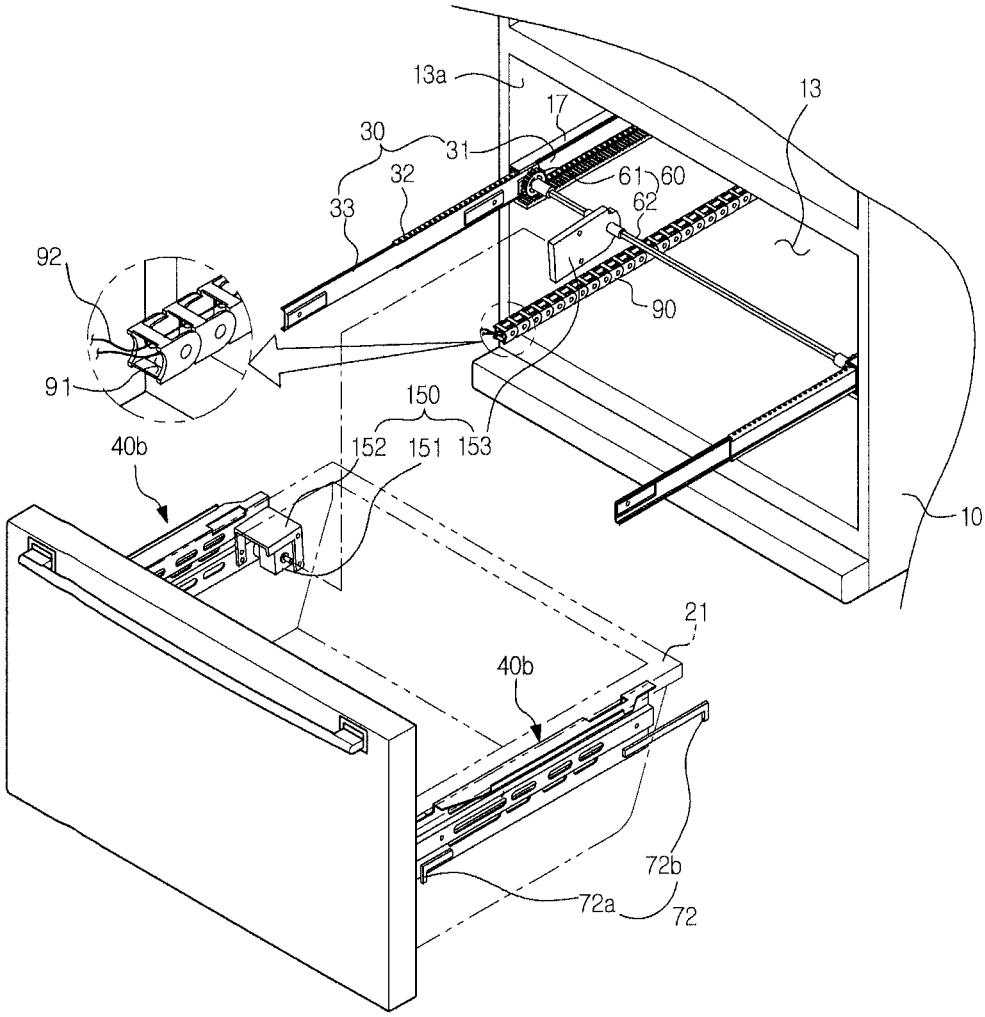
FIG. 6 is an exploded perspective view illustrating a storage compartment of a refrigerator according to another embodiment.
Figure 7:
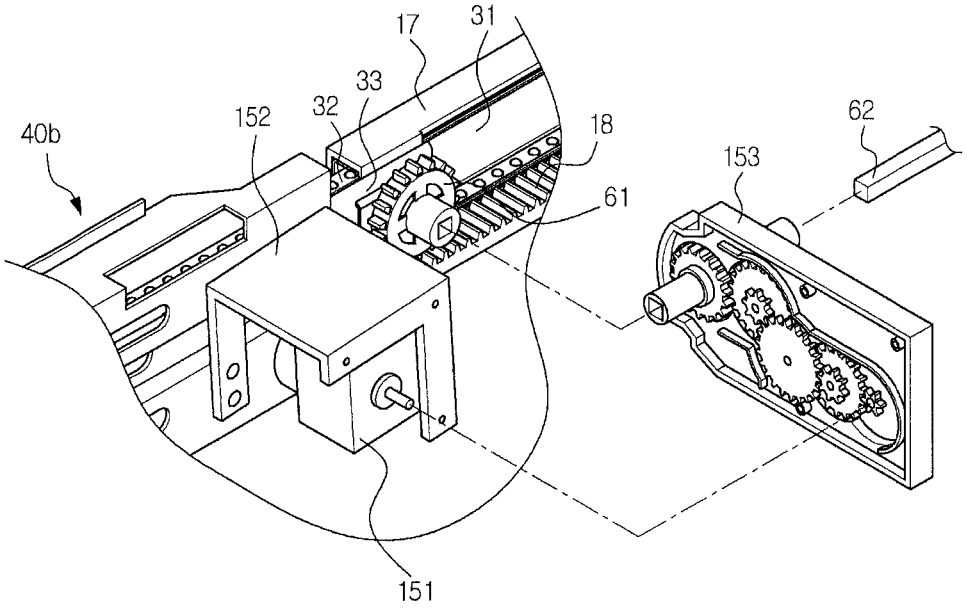
FIG. 7 is an enlarged perspective view illustrating important parts of the refrigerator shown in FIG. 6.
Figure 8:
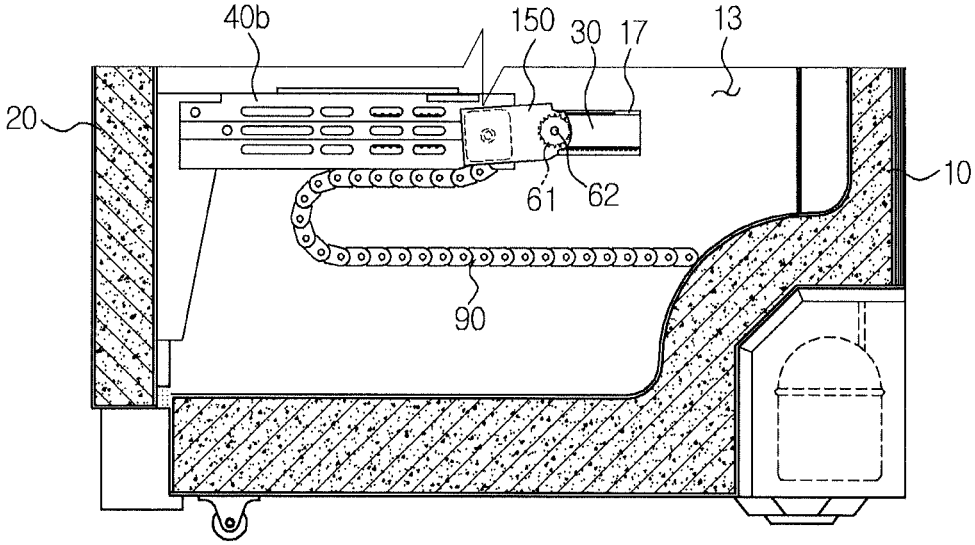
FIG. 8 is a view illustrating a closed state of the storage compartment of the refrigerator shown in FIG. 6.
Figure 9:
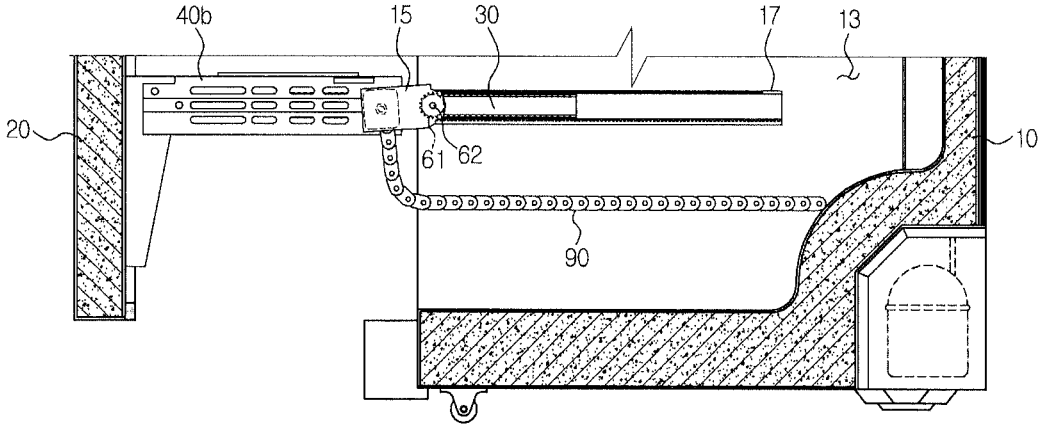
FIG. 9 is a view illustrating an open state of the storage compartment of the refrigerator shown in FIG. 6.
Figure 10:
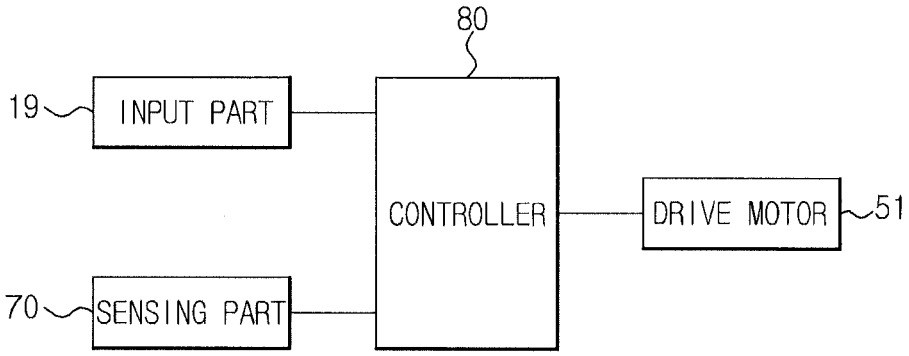
FIG. 10 is a control block diagram of the refrigerator according to the embodiments.

FIG. 6 is an exploded perspective view illustrating a storage compartment of a refrigerator according to another embodiment, and FIG. 7 is an enlarged perspective view illustrating important parts of the refrigerator shown in FIG. 6. Also, FIG. 8 is a view illustrating a closed state of the storage compartment of the refrigerator shown in FIG. 6, and FIG. 9 is a view illustrating an open state of the storage compartment of the refrigerator shown in FIG. 6.

As compared to the firstly-described embodiment, the refrigerator according to the secondly-described embodiment differs only in the configurations of the supporting member and the automatic door opening/closing apparatus used to automatically open or close the second storage compartment door, and other configurations may be equal to those of the firstly-described embodiment.

Hereinafter, the same configurations as the firstly-described embodiment are designated by the same reference numerals, and a description thereof will be omitted.

In the secondly-described embodiment, as shown in FIG. 6, a pair of left and right supporting members 40*b*, provided at the second storage compartment door 20, may be configured to correspond to each other, although they may be configured in the same manner as the firstly-described embodiment.

Specifically, although the firstly-described embodiment illustrates that any one supporting member 40*a* of the pair of supporting members 40 has the first rack gear 43 engaged with the first pinion 53, both the supporting members 40*b* of the secondly-described embodiment may have no first rack gear. Thus, the pair of supporting members 40*b* may have the corresponding configuration.

The automatic door opening/closing apparatus of the secondly-described embodiment, as shown in FIGS. 6 to 9, may include a drive device 150, input part 19, sensing part 70, and controller 80.

The drive device 150, as shown in FIGS. 6 and 7, may include a drive motor 151, and a reduction gear 153 that transmits rotating power of the drive motor 151 to the second storage compartment door 20.

The drive motor 151 is fixed to the second storage compartment door 20. Although the drive motor 151 may be fixed to any position of the second storage compartment door 20, in the secondly-described embodiment, for example, the drive motor 151 may be fixed to the first supporting member 40*b* by a bracket 152.

The reduction gear 153 is coupled to the rod member 62 of the connecting rod unit 60. When rotating power of the drive motor 151 is transmitted to the reduction gear 153, the reduction gear 153 acts to rotate the connecting rod unit 60 provided at the second storage compartment door 20 using the rotating power of the drive motor 151.

Specifically, as a result of the drive motor 151 acting to directly rotate the connecting rod unit 60, it may be possible to prevent unbalanced opening/closing operation of left and right sides of the second storage compartment door 20, enabling smooth opening/closing operation of the door. In addition, it may be possible to omit the pinion 53 that is separately provided at the reduction gear and the rack 43 that is separately provided at the first supporting member 40*a* to correspond to the pinion 53 (see FIG. 3).

In the secondly-described embodiment, in consideration of the fact that the drive motor 151 is mounted to the second storage compartment door 20 that performs sliding movement, a power cable 92 is provided for operation of the drive motor 151. The power cable 92 has one end connected to the drive motor 151 and the other end connected to a power source (not shown) of the body 10, and is adapted to move according to the sliding movement of the second storage compartment door 20.

The power cable 92 may break after extended use thereof because the power cable 92 is moved simultaneously with movement of the second storage compartment door 20.

To prevent breakage of the power cable 92, the secondly-described embodiment further includes a cable protecting unit 90.

The cable protecting unit 90, as shown in FIG. 6, is configured in such a manner that a plurality of unit blocks is coupled with one another so as to rotate relative to one another. The cable protecting unit 90 defines therein a receptacle 91, into which the power cable 92 may be inserted.

In the closed state of the second storage compartment door 20, the cable protecting unit 90, as shown in FIG. 8, has an approximately U-shaped form in which the power cable 92 is received. Also, in the open state of the second storage compartment door 20, the cable protecting unit 90, as shown in FIG. 9, has an I-shaped or J-shaped form, to guide movement of the power cable 92.

The above-described movement manner of the cable protecting unit 90 upon opening/closing operation of the second storage compartment door 20 is given by way of example. Also, the cable protecting unit 90 may be mounted to anywhere on the bottom surface 13*c* or the side surface 13*a* or 13*b* of the second storage compartment 13 based on design demands.

The cable protecting unit 90 of the secondly-described embodiment takes the form of a cable chain and exhibits uniform movement to guide the power cable 92 upon opening or closing of the second storage compartment door 20. Accordingly, the cable protecting unit 90 may prevent breakage of the power cable 92 even if the second storage compartment door 20 is opened or closed repeatedly for a long period of time.

Although the secondly-described embodiment proposes the cable chain as one example of the cable protecting unit 90, the power cable may take the form of a spring wire, such as an elastically deformable telephone wire, and otherwise, a variety of protecting units to protect the power cable despite long term movement thereof may be provided.

In the secondly-described embodiment, as a result of the drive motor acting to directly rotate the second pinions of the connecting rod unit, the second pinions are moved along the respective second rack gears, allowing the second storage compartment door to be opened away or closed to the second storage compartment.

In the secondly-described embodiment, the input part 19, sensing part 70, and controller 80 may be equal to those of the firstly-described embodiment, to realize the same operations as the firstly-described embodiment.

Next, a refrigerator according to a further embodiment of the present invention will be described.

Figure 12:
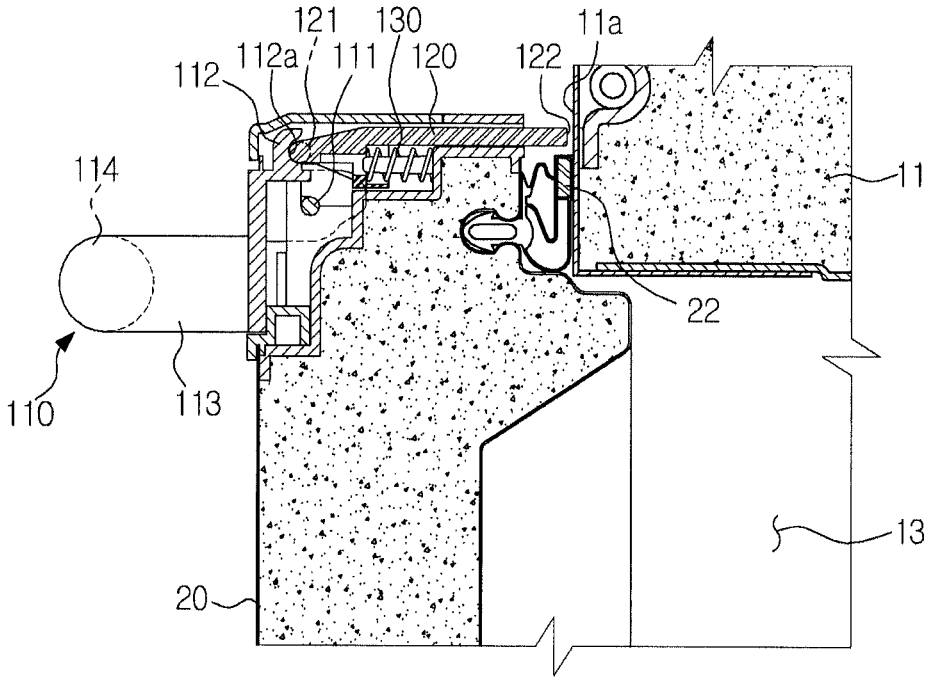
FIG. 12 is a sectional view illustrating a closed state of a storage compartment door according to a further embodiment of the present invention.
Figure 13:
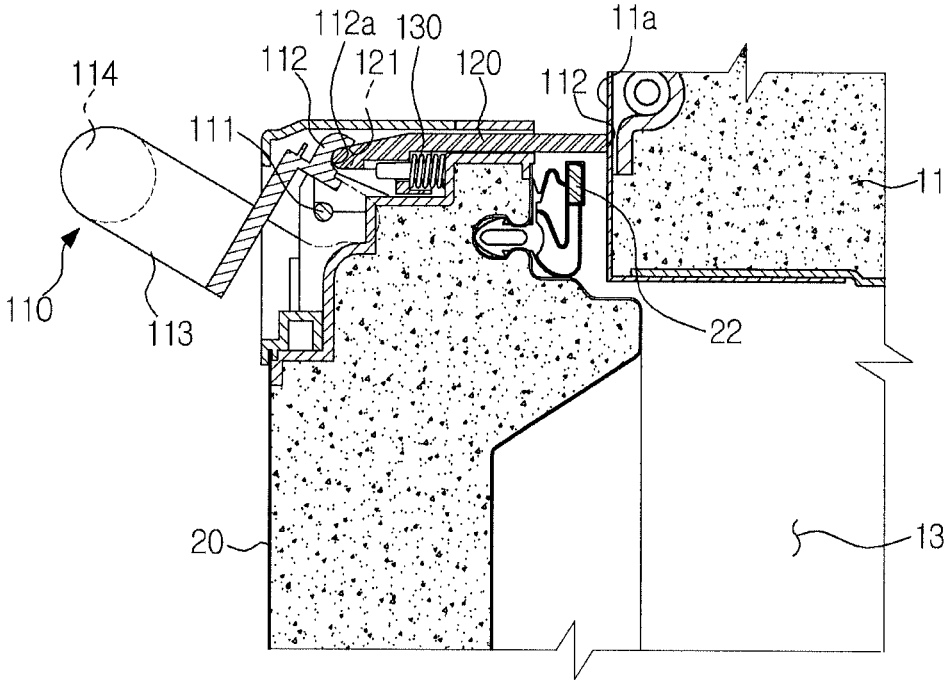
FIG. 13 is a sectional view illustrating an opening operation of the storage compartment door shown in FIG. 12.

FIG. 12 is a sectional view illustrating a closed state of a storage compartment door according to a further embodiment of the present invention, and FIG. 13 is a sectional view illustrating an opening operation of the storage compartment door shown in FIG. 12.

As compared to the above firstly and secondly described embodiments, the refrigerator of the thirdly described embodiment differs only in a handle unit 110 of the second storage compartment door 20 and an initial opening operation of the second storage compartment door 20 using the handle unit 110, and other operations may be equal to those of any one of the firstly and secondly described embodiments.

That is, the thirdly described embodiment may be realized by providing the refrigerator according to any one of the above firstly and secondly described embodiments with a structure to perform an initial opening operation of the second storage compartment door 20 in linkage with operation of the handle unit 110 of the second storage compartment door 20.

Hereinafter, the structure to perform the initial opening operation of the second storage compartment door 20 in linkage with operation of the handle unit 110 of the second storage compartment door 20 will be described by way of example, and the same configurations as the firstly-described embodiment are designated by the same reference numerals, and a description thereof will be omitted.

The refrigerator according to the thirdly described embodiment, as shown in FIGS. 12 and 13, includes the second storage compartment door 20 to open or close the second storage compartment 13 in a sliding manner, the handle unit 110 horizontally coupled to an upper portion of a front surface of the second storage compartment door 20 so as to be pivotally rotatable upward or downward, and a pair of push members 120 connected to the handle unit 110. If the handle unit 110 is pivotally rotated upward, the pair of push members 120 is moved from a backward position to a forward position in linkage with the upward pivotal rotation of the handle unit 110, thereby serving to move the second storage compartment door 20 away from the body 10.

The handle unit 110 is provided at the upper portion of the front surface of the second storage compartment door 20, thereby allowing the user to easily grip the handle unit 110 for moving the second storage compartment door 20 forward or rearward.

The handle unit 110 includes a rotating shaft 111 serving as an upward or downward pivoting rotation center of the handle unit 110, a pair of press pieces 112 extending upward from the rotating shaft 111 to allow each of the pair of push members 120 to move to the forward position thereof, a pair of levers 113 extending forward from the rotating shaft 111, and a grip rod 114 connecting the pair of levers 113 to each other.

The handle unit 110 is substantially parallel to an upper rim of the second storage compartment door 20.

The press pieces 112 are rotated clockwise as the levers 113 are pivotally rotated upward, thereby acting to move the push members 120 to the forward position thereof. Each of the press pieces 112 has an arcuately recessed press surface 112*a* to come into contact with the corresponding push member 120. Thus, as the press surface 112*a* of the press piece 112 presses an end of the push member 120, the push member 120 is moved to the forward position thereof.

A length of the grip rod 114 may be substantially equal to or somewhat smaller than a width of the second storage compartment door 20, to allow the user to easily grip the grip rod 114.

The pair of levers 113 is provided at both ends of the grip rod 114. If the user pivotally rotates the grip rod 114 upward, the pair of levers 113 integrally formed with the grip rod 114 is rotated about the rotating shaft 111, causing the press pieces 112 to press the push members 120.

Then, if the user lets go of the grip rod 114, i.e. if external force acting on the handle unit 110 is removed, the handle unit 110 is pivotally rotated downward about the rotating shaft 111 by the weight of the grip rod 114 and levers 113, thereby being returned to an original position thereof.

The push members 120 are slidably placed on an upper surface of the second storage compartment door 20 and serve to move the second storage compartment door 20 away from the body 10 by pressing a front surface 11*a* of the insulating partition 11 of the body 10. One end of each push member 120 is provided with an arcuate first contact portion 121 corresponding to the press surface 112*a* of the corresponding press piece 112, and the other end of the push member 120 is provided with a second contact portion 122 that transmits press force of the press piece 112 to the body 10.

An elastic member 130 is provided between each push member 120 and the second storage compartment door 20. The elastic member 130 serves to provide the push member 120 with restoration force to allow the second contact portion 122 of the push member 120 to be moved away from the body 10.

The above described configuration of the thirdly described embodiment is given to enable the initial opening operation of the second storage compartment door 20 in linkage with operation of the handle unit 110. Of course, various other configurations may be adopted to perform the initial opening operation of the second storage compartment door 20 in linkage with operation of the handle unit 110.

In the refrigerator according to the thirdly described embodiment, if the handle unit 110 is rotated about the rotating shaft 111 by pivotally rotating the grip rod 114 upward to open the second storage compartment 13, the press surfaces 112*a* of the press pieces 112 press the first contact portions 121 of the push members 120. In this case, the pair of push members 120 slides toward the body 10, thereby acting to press the rim of the body 10, i.e. the front surface 11*a* of the insulating partition 11.

The press force causes the gasket 22 of the second storage compartment door 20 to be spaced apart from the body 10 by a predetermined distance, releasing coupling between the second storage compartment door 20 and the body 10.

Thereafter, if the drive motor 51 is operated to move the second storage compartment door 20 that is in an initially open state, the second storage compartment door 20 may be automatically opened.

Although excessive load may occur upon initial operation of the drive motor 51 if it is attempted to open the second storage compartment door 20 that is in a closed state, according to the thirdly described embodiment, the drive motor 51 is driven after the second storage compartment door 20 is spaced apart from the body 10 by a predetermined distance, thus being free from occurrence of excessive load.

If the gasket 22 of the second storage compartment door 20 is spaced apart from the body 10 as the user rotates the handle unit 110, the sensing part 70 senses it and applies a sensed signal to the controller 80. As the controller 80 drives the drive motor 51, the second storage compartment door 20 may be automatically opened.

In the thirdly described embodiment, the open key 19*a* of the input part 19 of the firstly described embodiment is omitted. That is, even if the open key 19*a* does not generate an opening signal, the user may move the gasket 22 of the second storage compartment door 20 away from the body 10 by rotating the handle unit 110, thereby allowing the second storage compartment door 20 to be opened via driving of the drive motor 51.

Alternatively, if the open key 19*a* is not omitted, the second storage compartment door 20 may be automatically opened as the user selectively operates the open key 19*a* or rotates the handle unit 110.

Sensing that the gasket 22 of the second storage compartment door 20 is spaced apart from the body 10 is possible by sensing that the first sensor operator 72*a* is spaced apart from the first sensor 71*a* as the push members 120 push the body 10 such that the second storage compartment door 20 is moved away from the body 10 by a predetermined distance, or by sensing that the press force of the first sensor operator 72*a* against the first sensor 71*a* is lower than a predetermined pressure value. Alternatively, e.g., a magnetic sensor (not shown) may be used to sense that the gasket 22 of the second storage compartment door 20 is spaced apart from the body 10.

Closing of the open second storage compartment door 20 may be controlled in the same manner as operations of the above firstly and secondly described embodiments.

As is apparent from the above description, with an automatic door opening/closing apparatus according to the embodiments of the present invention, it may be possible to automatically open or close a door without applying any manual force to the door.

Further, the automatic door opening/closing apparatus may be operated based on detection of whether the door is in an open or closed state.

Furthermore, with operation of the automatic door opening/closing apparatus, it may be possible to substantially eliminate unbalanced opening/closing operation of the door.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An automatic door opening/closing apparatus to automatically open or close a sliding door that is mounted, in a drawer manner, to a refrigerator body, comprising:

the sliding door;

a drive device coupled to the sliding door to automatically open or close the sliding door with respect to the refrigerator body;

an input part to receive a user input and to operate the drive device based on the user input;

a sensing part to sense an open or closed state of the sliding door; and a controller to operate the drive device based on signals from the input part and signals from the sensing part, wherein the sensing part includes a first sensor and a second sensor provided at the refrigerator body to sense the closed state of the sliding door and to sense the maximally open state of the sliding door, respectively, and a first sensor operator and a second sensor operator provided at the sliding door to operate the first and second sensors, respectively, wherein the drive device includes a drive motor and a gear unit to transmit rotating power of the drive motor to the sliding door, wherein the sliding door includes a rack gear corresponding to the gear unit so as to be moved forward or rearward by rotation of the gear unit, and a connecting rod unit to connect a pair of sliding devices provided at the sliding door to prevent unbalanced opening/closing operation of the sliding door, and wherein the controller is configured to operate the drive device if an input signal is applied from the input part, and is configured to terminate the operation of the drive device if a signal informing of the open or closed state of the sliding door is applied from the sensing part.

2. The apparatus according to claim 1, wherein:

the connecting rod unit includes a pair of pinions, and a rod member to connect the pair of pinions to each other; and the refrigerator body includes a pair of rack gears corresponding to the pair of pinions.

3. The apparatus according to claim 2, wherein:

the drive device is mounted to the sliding door; and the gear unit is connected to the rod member to transmit rotating power of the drive motor to the connecting rod unit.

4. The apparatus according to claim 3, further comprising:

a power cable to supply power to the drive device; and a cable guide unit to prevent breakage of the power cable during opening/closing operation of the sliding door.

5. The apparatus according to claim 1, wherein the input part includes an open key to open the sliding door and a close key to close the sliding door, the open key and close key being provided at one of two refrigerator doors mounted to the refrigerator body.

6. The apparatus according to claim 5, wherein the drive device is operated in correspondence to an operating time of the open key.

7. The apparatus according to claim 1, wherein the input part includes a voice recognizer that transmits door opening/closing signals to the controller based on recognition of a user's voice.

8. The apparatus according to claim 1, wherein the sliding door includes a gasket attached to a rim of a rear surface thereof, the sensing part is configured such that the closed state of the sliding door is sensed after the gasket of the sliding door initially establishes contact with the refrigerator body.

9. The apparatus according to claim 1, wherein the first sensor operator presses the first sensor when the sliding door is closed to allow the first sensor to sense the sliding door is completely closed, and the second sensor operator presses the second sensor when the sliding door is opened to allow the second sensor to sense the sliding door is opened to the maximum extend.

10. A refrigerator comprising:

a refrigerator body having a storage compartment;

a sliding door to open or close the storage compartment;

a pair of sliding devices provided at the sliding door;

a pair of first rack gears provided at opposite inner side surfaces of the storage compartment;

a connecting rod unit to connect the pair of sliding devices to each other, the connecting rod unit including a pair of pinions corresponding to the first rack gears and a rod member to connect the pair of pinions to each other; and an automatic door opening/closing apparatus to automatically open or close the sliding door, wherein the automatic door opening/closing apparatus includes a drive device, an input part to receive input from a user, a sensing part to sense an open or closed state of the door, and a controller to operate the drive device based on the input from the user and the sensed open or closed state of the door, wherein the sensing part includes a first sensor and a second sensor provided at the storage compartment to sense the closed state of the sliding door and to sense the maximally open state of the sliding door, respectively, and a first sensor operator and a second sensor operator provided at the sliding door to operate the first and second sensors, respectively, and wherein the controller is configured to operate the drive device if an input signal is applied from the input part, and is configured to terminate the operation of the drive device if a signal informing of the open or closed state of the sliding door is applied from the sensing part.

11. The refrigerator according to claim 10, wherein the drive device includes a drive motor mounted to the sliding door, configured to transmit rotating power of the drive motor to the connecting rod unit.

12. The refrigerator according to claim 11, wherein the drive device includes a reduction gear directly connected to the rod member, serving to transmit rotating power of the drive motor to the connecting rod unit.

13. The refrigerator according to claim 10, wherein:

the sliding door includes a rack gear; and the drive device includes a drive motor mounted to the storage compartment, and a gear unit connected to the drive motor, the gear unit being engaged with the rack gear of the sliding door.

14. The refrigerator according to claim 10, wherein the sliding door includes a gasket attached to a rim of a rear surface thereof, the sensing part is configured such that the closed state of the sliding door is sensed after the gasket of the sliding door initially establishes contact with the refrigerator body.

15. A refrigerator comprising:

a refrigerator body;

a refrigerating compartment and a freezing compartment vertically divided in the refrigerator body;

a drawer type door to open or close the freezing compartment;

a pair of sliding devices provided at the drawer type door;

a connecting rod unit to connect the pair of sliding devices to each other, to prevent unbalanced opening/closing operation of the door;

pinions provided respectively at both ends of the connecting rod unit;

a pair of first rack gears provided at side surfaces of the freezing compartment to correspond to the pinions;

a drive motor mounted to the freezing compartment;

a gear unit connected to the drive motor;

a second rack gear provided at the drawer type door and serving to convert rotation of the gear unit into linear movement so as to move the drawer type door forward or rearward;

an input part to receive a user input and to operate the drive motor based on the user input;

a sensing part to sense an open or closed state of the sliding door; and a controller to operate the drive motor based on signals from the input part and signals from the sensing part, wherein the sensing part includes a first sensor and a second sensor provided at the freezing compartment to sense the closed state of the drawer type door and to sense the maximally open state of the drawer type door, respectively, and a first sensor operator and a second sensor operator provided at the drawer type door to operate the first and second sensors, respectively, and wherein the controller is configured to operate the drive motor if an input signal is applied from the input part, and is configured to terminate the operation of the drive motor if a signal informing of the open or closed state of the sliding door is applied from the sensing part.

16. A refrigerator comprising:

a refrigerator body in which first and second storage compartments are vertically defined;

a second storage compartment door to open or close the second storage compartment defined in a lower region of the refrigerator body;

a handle unit movably coupled to the second storage compartment door;

a push member to press the refrigerator body in linkage with movement of the handle unit, allowing the second storage compartment door to be spaced apart from the refrigerator body by a predetermined distance;

a drive device coupled to the second storage compartment door, serving to automatically open or close the second storage compartment door in a sliding manner with respect to the refrigerator body;

a sensing part to sense that the second storage compartment door is spaced apart from the refrigerator body by the predetermined distance;

a controller that is configured to operate the drive device to open the second storage compartment door if the sensing part senses that the second storage compartment door is spaced apart from the refrigerator body by the predetermined distance; and an input part to receive a user input and to operate the drive device based on the user input, wherein the sensing part includes a first sensor and a second sensor provided at the second storage compartment to sense the closed state of the second storage compartment door and to sense the maximally open state of the second storage compartment, respectively, and a first sensor operator and a second sensor operator provided at the second storage compartment door to operate the first and second sensors, respectively, and wherein the controller is configured to operate the drive device if the input part generates an opening signal in response to user manipulation, and if the sensing part senses that the second storage compartment door is spaced apart from the refrigerator body.

* * * * *